US007946937B2

(12) United States Patent
Searle

(10) Patent No.: US 7,946,937 B2
(45) Date of Patent: May 24, 2011

(54) SILICONE BASED ARTICLE FOR USE WITH SPORTS EQUIPMENT AND OTHER PRODUCTS

(76) Inventor: Benjamin M. Searle, Surprise, AZ (US)

( * ) Notice: Subject to any disclaimer, the term of this patent is extended or adjusted under 35 U.S.C. 154(b) by 0 days.

(21) Appl. No.: 12/397,670

(22) Filed: Mar. 4, 2009

(65) Prior Publication Data

US 2009/0291784 A1 Nov. 26, 2009

Related U.S. Application Data

(60) Provisional application No. 61/054,683, filed on May 20, 2008, provisional application No. 61/121,726, filed on Dec. 11, 2008.

(51) Int. Cl.
*A63B 49/14* (2006.01)

(52) U.S. Cl. ..... 473/521; 473/539; 473/548

(58) Field of Classification Search ..... 473/520–522, 473/539, 548
See application file for complete search history.

(56) References Cited

U.S. PATENT DOCUMENTS

| | | | | |
|---|---|---|---|---|
| 4,948,131 | A | 8/1990 | Nakanishi | |
| 5,277,423 | A | 1/1994 | Artus | |
| 6,623,384 | B2 * | 9/2003 | Kanemitsu | 473/521 |
| 6,964,624 | B2 * | 11/2005 | Shen et al. | 473/521 |
| 6,969,328 | B2 * | 11/2005 | Okamoto | 473/521 |
| 7,012,111 | B2 * | 3/2006 | Kanemitsu et al. | 524/406 |
| 2002/0058557 | A1 * | 5/2002 | Kanemitsu | 473/520 |
| 2004/0048698 | A1 * | 3/2004 | Kanemitsu et al. | 473/520 |
| 2005/0009649 | A1 * | 1/2005 | Okamoto | 473/521 |
| 2005/0159253 | A1 * | 7/2005 | Shen et al. | 473/520 |
| 2009/0291784 | A1 * | 11/2009 | Searle | 473/521 |

FOREIGN PATENT DOCUMENTS

| | | | |
|---|---|---|---|
| JP | 3656136 | B2 | 3/2005 |
| WO | WO 98/47574 | A1 | 10/1998 |

* cited by examiner

*Primary Examiner* — Raleigh W. Chiu
(74) *Attorney, Agent, or Firm* — Leason Ellis LLP

(57) ABSTRACT

In one embodiment of the present invention, an article that generally consists of a silicone material in combination with a fastening member, such as an adhesive backing, is provided and configured for easy application to a surface, including those associated with a variety of racquet sports, sporting goods, etc. The combination of the silicone material with the fastening member is hereby referred to as a "silicone adhesive product" that, as described below, overcomes the deficiencies of conventional sports equipment accessories, protects the sports equipment, reduces vibration; and can offer the degree of customization desired by some sports participants.

21 Claims, 7 Drawing Sheets

SILICONE BASED ARTICLE FOR USE WITH SPORTS EQUIPMENT AND OTHER PRODUCTS

CROSS-REFERENCE TO RELATED APPLICATIONS

The present application claims the benefit of U.S. patent application Ser. No. 61/054,683, filed May 20, 2008, and U.S. patent application Ser. No. 61/121,726, filed Dec. 11, 2008, each of which is hereby incorporated by reference in its entirety.

TECHNICAL FIELD

The present invention relates to articles of manufacture, including but not limited to accessories for sports equipment, and in particular, to a silicone based article for protecting sports equipment from damage caused by collisions, for absorbing vibrations, and for optionally adding customizable ornamentation to sports equipment.

BACKGROUND

Traditional sports participants, such as, but not limited to, tennis, racquet ball, squash, baseball, golf, and football players have needs and wants with their sporting equipment. In addition, non-traditional sport participants, including without limitation, power sports riders, bike riders, snow skiers/boarders, skate boarders, wake boarders, etc. have similar needs and wants with their sports equipment. Three of these needs and wants are equipment protection, customization, and vibration reduction to allow for a better experience.

Moreover, sports participants many times have a strong desire to customize their equipment and make it aesthetically pleasing in a way that reflects their individuality and uniqueness as a person. Sports participants can accomplish this with color, text, patterns, and graphics that are applied to or made as an integral part of their equipment. For instance, a snowboarder may apply stickers to his or her board that reflect the individuals personality, or a motorcycle rider may apply paint to his or her motorbike to customize it, or a sneaker manufacturer may customize a color scheme and sneaker design in view of a sports celebrity, such as a basketball star.

As there are advances in technology and materials, the cost of sports equipment continues to increase for a wide range of premium products that tend to be the products most in demand by the public. Unfortunately, many types of sports equipment are damaged during use, and given the significant investment already made in purchase of the sports equipment, sports participants desire protection and a longer usable life for the sports equipment. For example, a tennis player frequently hits his or her racquet on the court during the course of play potentially damaging and wearing down the racquet. In order to protect the tennis racquet, tennis players, for instance, often use a protective head tape applied to their racquet to prevent chipping, and scratching of the racquet frame caused by the racquet hitting the court during the course of play. However, head tape offers minimal protection and, after as few as one forceful hit to the court, the head tape will likely shred and offer no real protection. In addition, the head tape becomes a shredded and gooey mess on the frame. Therefore, many players will remove and reapply the head tape many times which is burdensome to the player, or, more often than not, the player will cease to use the head tape because of the minimal protection and extra burden and hardship related to using existing types of head tapes.

A related problem of sports equipment becoming chipped or damaged concerns a mountain bike frame which can be scratched and chipped during rigorous riding. It is therefore desirable for the bike frame to include some type of frame protection.

Another concern with the use of sports equipment is that a number of sports participants experience excessive vibration traveling through the equipment causing pain and possible injury as a result of the vibration transmitted from the equipment to the person's hands and body during play. Some common scenarios are golfers, tennis, and baseball players striking a ball causing vibration and shock to travel up the player's piece of sports equipment and then transmitted to the player's hand and body. This vibration can be painful and even cause damage to the player's bones and joints.

Therefore, there is a need for a device that can be easily applied to sports equipment offering protection and vibration reduction and optionally offering customization thereof. The embodiments described herein satisfy these and other needs.

SUMMARY

In one embodiment of the present invention, an article that generally consists of a silicone material in combination with a fastening member, such as an adhesive backing, is provided and configured for easy application to a surface, including those associated with a variety of racquet sports, sporting goods, etc. The combination of the silicone material with the fastening member is hereby referred to as a "silicone adhesive product" that, as described below, overcomes the deficiencies of conventional sports equipment accessories, protects the sports equipment, reduces vibration, and can offer the degree of customization desired by some sports participants.

In one embodiment, the present invention is in the form of a head guard for use with a sports racquet. The head guard includes an elongated silicone rubber article having first and second side edges and a central slot formed therethrough. The slot is divided into a number of discrete segmented openings by a plurality of integral transverse ribs that extend across the slot at spaced intervals. The article has at least one fastening element located along an inner surface thereof that mates with an outer edge of a head of the sports racquet for coupling the article to the head.

The present invention also relates to a method for protecting a head of a sports racquet and for providing vibration dampening of the racquet including the steps of: (1) providing an elongated silicone rubber article having first and second side edges and a central slot formed therethrough, the slot being divided into a number of discrete segmented openings by a plurality of integral transverse ribs that extend across the slot at spaced intervals, the article having at least one fastening element located along an inner surface thereof, (2) aligning the article relative to an outer edge of the head of the sports racquet such that tensioned string segments that are part of the strings that form a striking surface of the racquet are accessible through the segmented openings; and (3) securely adhering the inner surface of the article to the outer edge of the head by means of the at least one fastening element.

These and other aspects, features and advantages shall be apparent from the accompanying Drawings and description of certain embodiments of the invention.

DETAILED DESCRIPTION OF CERTAIN EMBODIMENTS OF THE INVENTION

In one embodiment of the present invention, an article that generally consists of a silicone material in combination with a fastening member, such as an adhesive backing, is provided and configured for easy application to a surface, including those associated with a variety of racquet sports, sporting goods, etc. The combination of the silicone material with the fastening member is hereby referred to as a "silicone adhesive product" that, as described below, overcomes the deficiencies of conventional sports equipment accessories, protects the sports equipment, reduces vibration; and can offer the degree of customization wanted by some sports participants.

The article is formed of a silicone material and in one embodiment, the article is formed of a silicone rubber material. For example, one suitable type of silicone rubber material is available from Don Jue Fine Chemicals (Nanjing) Co., Ltd. This type of material is similar to the silicone based bracelets that have been popular in recent times; however, other sources of silicone rubber material exist. The silicone rubber material is comprised generally of silicone gum and silica. In addition, the silicone rubber material is suitable for extrusion and therefore, can advantageously be formed to have any number of different shapes and sizes depending upon the end use of the article. It will be appreciated that the material used to form the article can be a silicone material having a different composition than the aforementioned so long as the article is capable of adhering to a surface of the fastener which in turn adheres the article to an object, such as a racket or golf club, etc.

The article of the present invention is subtle, easy to adhere and to remove, thin and durable. It not only protects a surface of a piece of sports equipment, such as a sports racquet, thereby prolonging the racquet life, but the silicone adhesive product can also be optionally customized or personalized. In addition, the silicone based article can be clear, colored or consist of different colors, color designs, color variations, decorative designs, names, symbols, artwork, different fonts, logos, etc. The silicone adhesive product can also be printed on top to provide further customization or it can also be screen printed or debossed.

In one aspect of the present invention, the silicone material is preformed to have a certain shape depending upon the particular application. For example, when the article is to be applied to sports equipment, the article is preformed to have a complementary shape to the surface to which the article is to be applied.

Figure 1:
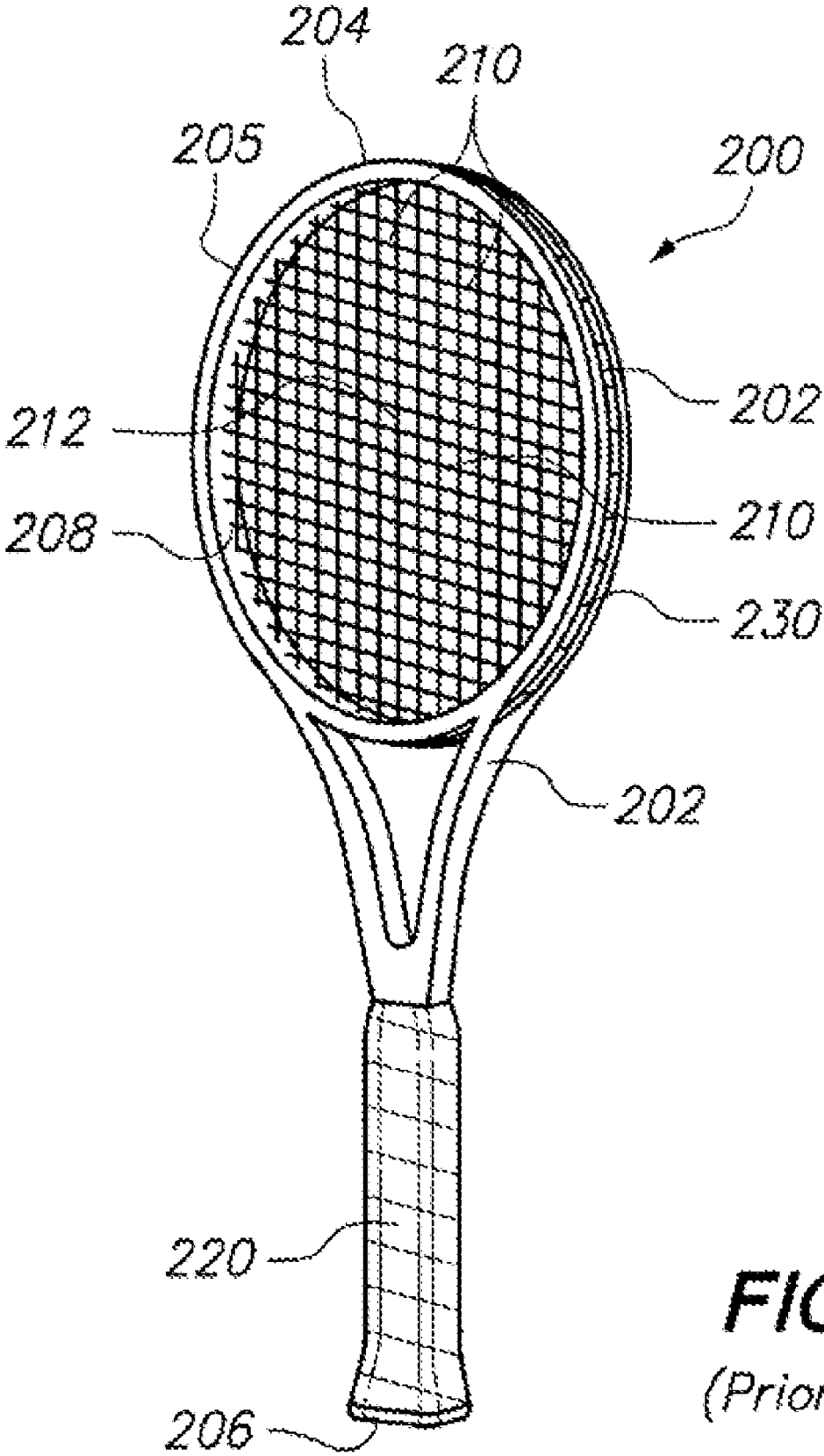
FIG. 1 (Prior Art)
FIG. 1 is a perspective view of a conventional tennis racket.
Figure 2:
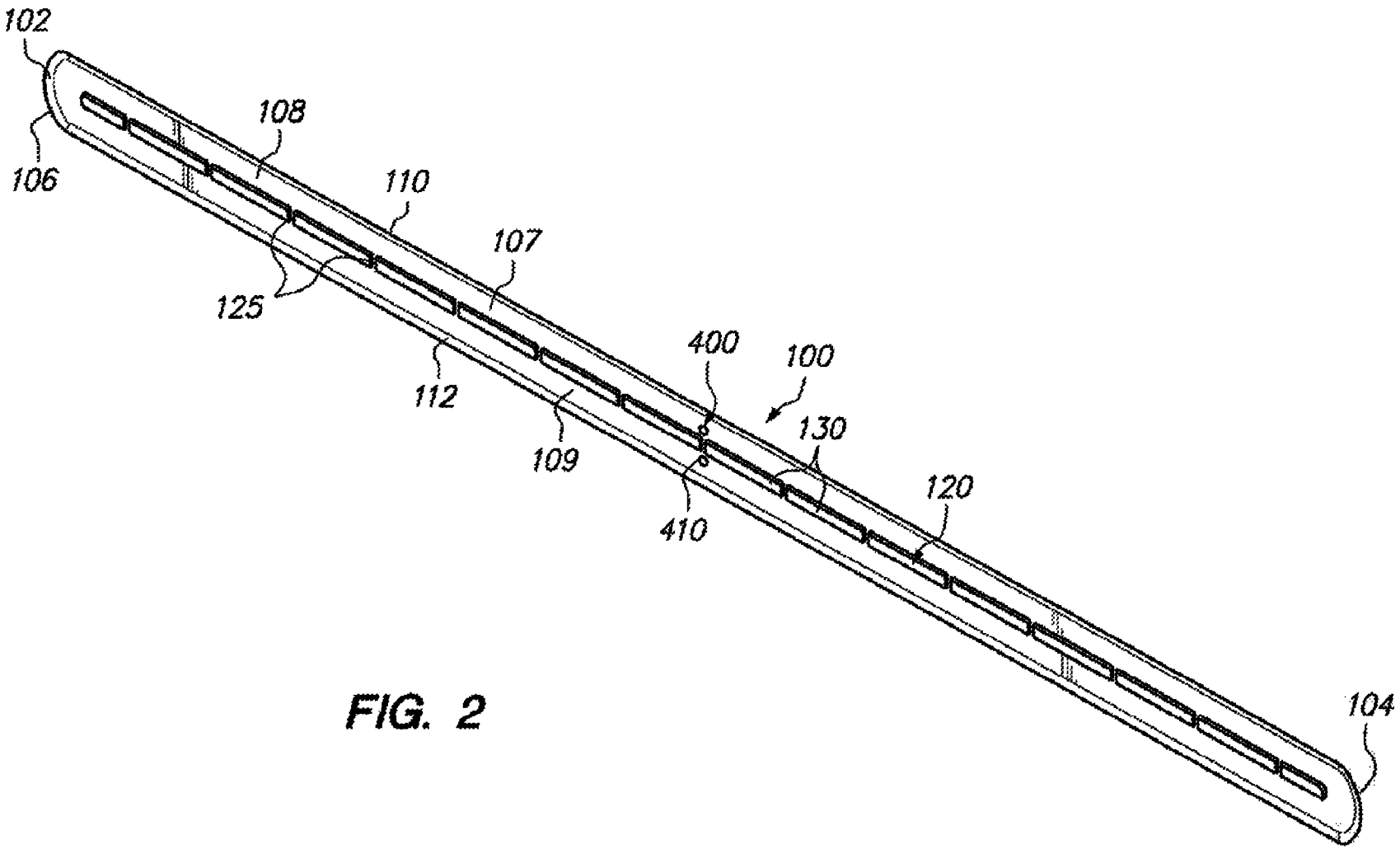
FIG. 2 is a perspective view of a silicone article (silicone adhesive product) in accordance with one embodiment of the present invention for use with a sports racquet.
Figure 3:
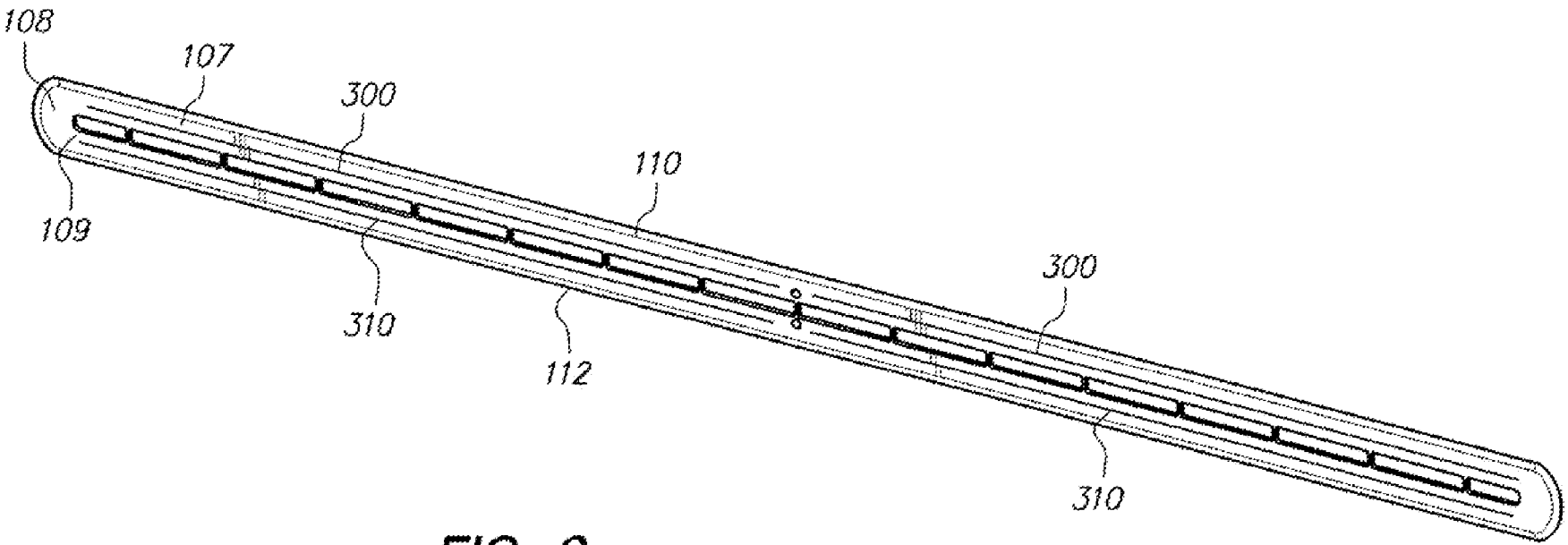
FIG. 3 contains other view of the article of FIG. 2.

FIGS. 2-3 illustrate an article 100 in the form of a bumper or head guard or head protector for use in racquet sports and in particular for use with a sports racquet generally shown at 200 in FIG. 1. It will be appreciated that a sports racquet 200 can be in the form of a tennis racquet, pickle ball racquet, racquetball racquet, etc. In other words, the racquet 200 is used for striking a ball in such games as squash, tennis, racquetball, and badminton. Collectively, these games are known as racquet sports. FIG. 1 generally shows a tennis racquet 200 which, as is known, is a sports implement formed of a handled frame 202 having a head end 204 and an opposite handle end 206. Adjacent the head end 204 is an opening 208 defined by a head 205 of the racquet 200 and across which strings 210 are secured under tension to constitute a hitting surface 212. Either side of the strings 210 can constitute the hitting surface 212. Located at the handle end 206 is a handle 220 for being gripped by the user of the racket 200. Conventionally, the racquet's frame 202 is usually considered to be those parts that are not replaceable, namely, the head 205, shoulders, throat, shaft, and handle 220. A grommet strip 230 and grip are part of the frame 202 in some contexts, but they can also be considered as separate parts. The strings 210 are never considered part of the frame 202. The grommet strip 230 is located in a string groove formed of the outside of the frame head 205 and is typically in the form of a strip of plastic material containing small tubes that run through the framers string holes. The plastic protects the strings 210 from rubbing against the abrasive frame material. The outer, flat surface of wider grommet strips can also act as a bumper guard.

The strings 210 form a woven network inside the hoop of the racquet frame 202. Racquets 200 are typically strung with either two separate strings 210 and four knots, often due to a hybrid of two differing string types, or with a single string 210 with only two knots. Traditionally, a double half hitch has been used for tie-offs along with a starting knot.

FIGS. 2-3 illustrate one exemplary article 100 according to the present invention. The article 100 is an elongated structure that is sized and shaped to be complementary to the head of the racquet 200. More specifically, the article 100 can be in the form of an elongated structure that has a first end 102 and an opposite second end 104. The article 100 has an outer surface 106 that faces outwardly when the article 100 is applied to a member, in this case, the racquet 200 and it includes an opposite inner surface 108 that faces inwardly. The article 100 includes a first side section 107 that include a first side edge 110 that extends between the first and second ends 102, 104 and a second side section 109 that include a second side edge 112 that is spaced from the first edge 110 and extends between the first and second ends 102, 104.

In one embodiment, at least the first and second edges 110, 112 are in the form of rounded edges of the article 100. In other words, the edges 110, 112 are not straight cut edges but have a curved or rounded appearance. The rounded nature of edges 110, 112 provides a number of advantages to the article 100 and in particular, the arcuate (curved) nature of the edges 110, 112 decreases the likelihood that the article 100 will catch on another member that could lessen the bond between the article 100 and the racquet 200 itself. In other words, the curved (rounded) edges 110, 112 hinder the article 100 being pulled away from the racquet frame 102.

The article 100 includes a central opening or slot 120 that extends at least partially along a length of the article 100. As shown in FIGS. 2-3, the slot 120 extends along a substantial length of the article 100 but terminates prior to ends 102, 104. The slot 120 can have any number of different shapes; however, in the illustrated embodiment, the slot 120 is a relatively thin elongated slot. It will be appreciated that in one embodiment, the slot 120 is not continuous but rather is segmented in that there are a plurality of ribs 125 (connecting segments) that extend across the slot 120 at preselected location so as to define a plurality of enclosed slot segments 130. Each slot segment 130 is isolated from adjacent slot segments. In the case of the article 100 being in the form of a bumper guard for use in racquet sports, each slot segment 130 is designed to permit access to the strings 210 to permit restringing or repair thereof. In addition, the inclusion of the slot 120 reduces the overall weight of the article 100 while not adversely impacting the protective and vibration damper characteristics thereof. The thin ribs 125 assist in the article 100 staying aligned. In one embodiment, the ribs 125 are spaced about one inch apart from one another.

More specifically, the article 100 is intended to be used with and secured to a racquet, such as tennis racquet 200 (FIGS. 1 and 4) or a racquetball racquet 500 (FIG. 5) or any other type of hand racquet. In this application, the article 100 can be referred to as being a tennis racquet head guard, head protector, or specialized head tape. In order to securely attach the article 100 to the racquet head 205, the inner surface 108 includes some means for securely coupling the article 100 thereto. For example, the means can be in the form of an adhesive material with a protective covering that is removed at the time of application of the article 100 to the racquet head 205. For example and as illustrated in FIG. 3, the inner surface 108 can include a first fastener 300 in the form of an elongated strip that extends along a length of the article 100 adjacent the edge 110 and a second fastener 310 in the form of an elongated strip that extends along a length of the article 100 adjacent the edge 112.

The first and second fasteners 300, 310 can be in the form of a layer of adhesive material that is deposited in a strip fashion along the first and second side sections 107, 109 of the inner surface 108 of the article 100 adjacent the first and second edges 110, 112, respectively. The adhesive material is then covered with a releasable protective cover (release paper) 320 such that the user simply removes the protective covers 320 from each of the adhesive strips 300, 310 and then properly aligns the article 100 relative to the racquet as described below and then applies pressure to the outer surface 106 of the article 100 resulting in secure attachment of the article 100 to the racquet head 205. Suitable adhesives are those adhesives that are intended for use with silicone based products, such as the article 100.

It will also be appreciated that the first and second fasteners 300, 310 can be in the form of transparent double adhesive tape that is first applied to the inner surface 108 along each of the first and second edges 110, 112 and then when the user wishes to apply the article 100 to the racquet head 205, the protective covers (not shown) are removed. One type of double adhesive tape that can be used is commercially available from 3M. It will be understood that the fastener does not have to be in the form of continuous strips of adhesive material but instead can be in the form of segmented adhesive strips or deposits that serve to locally adhere the article 100 to the racquet head 205.

The article 100 is applied to the racquet head 205 such that the two fasteners 300, 310 overlie the two peripheral edge sections of the frame head 205, with the slot 120 being disposed over the grommet strip 230 that is located in a string groove formed of the outside of the frame head 205. By adhering the article 100 such that the ribs 125 are offset from the knots of the strings, the slot segments 130 are disposed over the knots to allow for easy restringing of the racquet without removal of the article 100. The width of the article 100 is such that the fasteners 300, 310 overlie the two surfaces adjacent and on opposite sides of the string groove, thereby providing a smooth, relatively flat surface to which the fasteners (adhesive material) can be pressed against and applied to for securely attaching the article 100 to the racquet 200.

Figure 4:
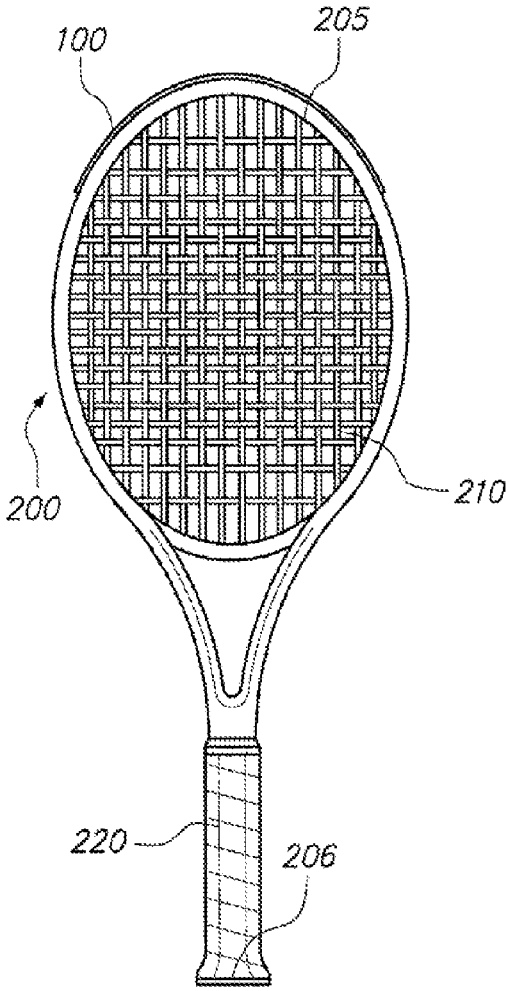
FIG. 4 is a front elevation view of the article of FIG. 2 adhered to a tennis racket.
Figure 5:
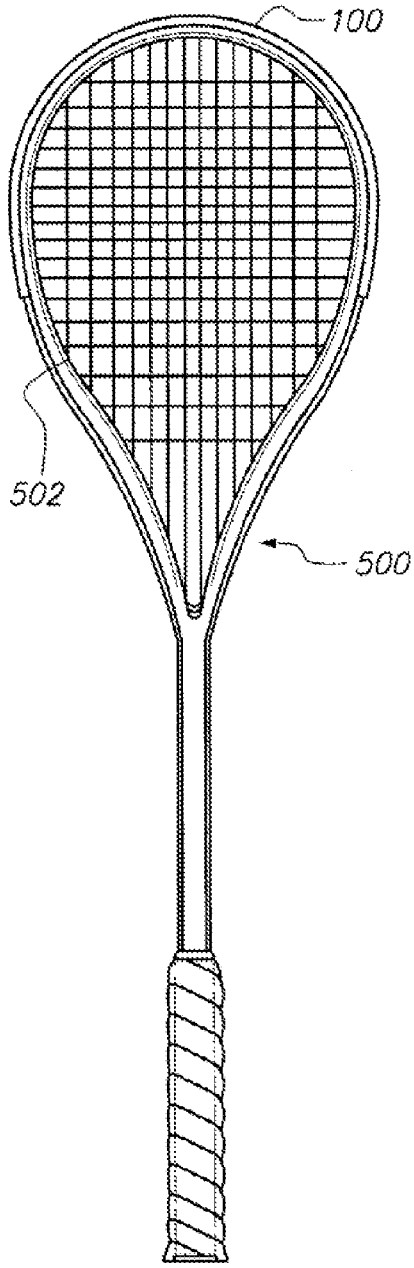
FIG. 5 is a front elevation view of the article of FIG. 2 adhered to a squash racquet.
Figure 6:
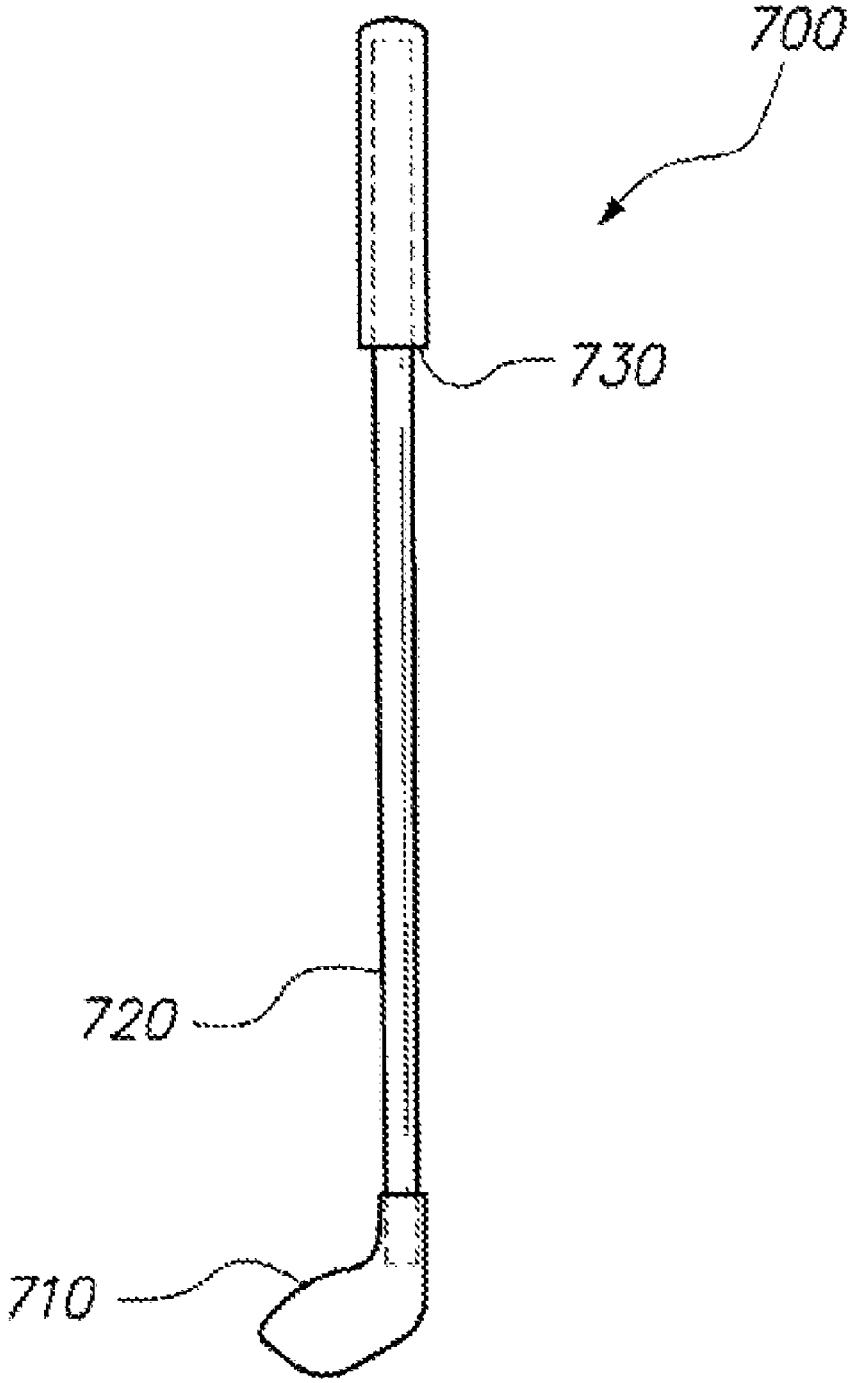
FIG. 6 (Prior Art)
FIG. 6 is a view of a conventional golf club.

FIG. 4 generally shows article 100 adhered to the head 205 of racquet 200 and FIG. 5 shows article 100 adhered to a head 502 of a squash racket 500. FIG. 6 shows a golf club 700 that includes a head 710, shaft 720, and grip 730 to which a silicone adhesive product in accordance with the present invention can be applied.

In one illustrative embodiment, the article 100 has a width of about 1 inch, a length of about 18 inches and a thickness of about 1 mm. The slot (opening) 120 has a width of about ⅛ inch. These dimensions are merely exemplary and not limiting of the present invention since the article 100 can come in any number of other sizes.

In yet another aspect shown in FIG. 2, the article 100 can include a locating feature, generally indicated at 400, to assist the user in locating the article correctly and in an even manner. For example, the locating feature 400 can be in the form of a pair of openings or marks 410 that are disposed between the center slot area and the edges 110, 112, with one mark being on one side of the slot 120 proximate edge 110 and the other being on the other side of the slot 120 proximate edge 112. As shown, the locating marks 410 can be axially aligned with one rib (a center rib) 125. When aligning the article 100 to the head 205, the marks 410 are aligned with a top center portion of the head 205 to ensure the article 100 is applied evenly along the arcuate edge of the head 205.

It will also be appreciated that the article 100 can come in any number of different forms, including but not limited to, a roll or it can be provided as segments that can be packaged with one another or can be packaged individually as one segment (product) to be used in a given application.

The present invention offers better protection for sporting equipment. As previously mentioned, tennis players, for instance, use a protective head tape applied to their racquet to prevent cracking, chipping, and scratching of the racquet frame caused by the racquet hitting the court during the course of play. The article 100 is more durable than head tape due to its silicone based formula. The article 100 holds up substantially longer as long as most head tapes. During testing, the article 100 would take at least twice the number of impacts on the court or twice the force to tear and wear out as compared to head tapes tested. Plus, current head tapes do not dampen, any or very little, vibration that travels up the racquet to the players hand, arm, and body. The article 100, because of its silicone content, dampens a greater portion of the vibration caused by the force of the racquet hitting the court and/or the ball. Head tape doesn't.

The present invention is easy to apply and remove to and from sports equipment. Although other forms of silicone had been know to absorb shock and offer personal customization with color, text, and graphics (i.e. bracelets), silicone has not been made user friendly or very effective in adhering to materials commonly used for sports equipment. Because of an oily-type base, silicone is very difficult to apply to equipment and many other materials. Therefore, most have used materials other than silicone when attempting to apply a device to sports equipment with adhesive. In the past, silicone wasn't used to adhere to sports equipment because special silicone glue, ineffective two-sided tape, or straps didn't do a satisfactory job. The silicone glue is very messy to apply and generally takes an extended period of time to dry and adhere (12-24 hours) the silicone to another object. Two-sided tape is easier to apply, but doesn't adhere well enough to the conventional silicone to keep it attached to another object. Straps add weight to the silicone device and make it less aesthetically pleasing. These problems have kept users away from using conventional 100% silicone when adhesion is necessary.

It will also be appreciated that the above described silicone based article with adhesive backing is not limited to be used with only a sports racquet (e.g., tennis racquet, pickle ball racquet, racquetball racquet) but instead the present invention also applies to use of the silicone adhesive product onto the grips of racquet sports handles such as a tennis racquet, golf club (see FIG. 6), lacrosse stick, hockey stick, baseball or softball bat, as well as mountain bike/bike handlebars, motorcycle handlebars, etc. to dampen vibration, improve grip and provide a personalized/customized decorative product. Moreover, the present invention also applies to use of the silicone adhesive product onto sporting goods/sporting equipment, such as fishing rods, bows and arrow, mountain bike chain guards, etc. for cushioning, protection, vibration dampening, decorative expression, etc. The present invention can also be applied to vibration dampeners, clothing, sneakers, head and wristbands, gym bags and other accessories.

Prior to applying, the silicone adhesive product (e.g., article 100) can be trimmed/customized as well as being applied in singular form or layers.

The silicone adhesive product (e.g., article 100) thus protects against some of the pains and injuries athletes experience while playing sports, such as but not limited to tennis, racquet ball, biking, golfing, shouting, and baseball. "Tennis elbow," a form of tendonitis, can be prevented and reduced if less shock travels to an athlete's hand and arm. This and other pains and injuries can reduce the amount of enjoyment and play occasions a participant has in his or her sport. The present invention gives users the benefit of decreasing pain and injury while increasing enjoyment and performance.

Sports participants are continuously striving to customize their sports equipment to reflect their individuality and personality. The silicone adhesive product of the present invention offers personal customization to the individual including custom color, debossed or silkscreen indicia (e.g., text, name, phrase, and graphics). The outer surface 106 of the article 100 offers a surface on which corporate indicia, such as manufacturer information or advertising information, can be placed.

Another of the benefits provided by the present invention is the integration of fulfilling three needs and wants (customization, protection, and vibration reduction) of sports participants into one device. Less weight and material needs to be added to a piece of sports equipment to get customization, protection, and vibration reduction. For example, instead of a tennis player applying excessive head tape, large string mounted shock absorbers, and different types of ornamentation (stickers, paint, or widgets) to customize the racquet, he or she can simply apply the present invention achieving the same desired outcome, yet limiting additional weight, that may harm performance.

The customization can take place at the time of manufacture (e.g., molded features) or it can take place after.

It will be understood that the present invention encompasses the following points: (1) a silicone material with adhesive backing that is used on racquet sports, such as tennis racquets, pickle ball racquets, racquetball racquets, badminton racquets, etc. for cushioning, protection, vibration dampening, decorative expression and the like; (2) a silicone material with adhesive backing that is used as a grip on sports equipment, such as racquet sports, golf clubs, baseball or softball bats, hockey sticks, lacrosse sticks, ping pong paddles, mountain bike/bike handlebars, motorcycle handlebars and the like; (3) a silicone material with adhesive backing that is used on sporting goods and sports equipment, such as fishing rods, guns, skis and ski poles, wakeboards, bows and arrows, bats, hockey sticks, lacrosse sticks, bikes, mountain bikes, motorcycles, chain guards, etc. for cushioning, protection, vibration dampening, decorative expression and the like; (4) a silicone adhesive product that can be applied to vibration dampeners/shock absorbers, clothes, sneakers, head and wristbands, visors and caps, gym bags and other accessories in singular form or layers; (5) a silicone adhesive product that can be customized/personalized; (6) a silicone adhesive product that can be clear, colored, multi-colored, marbleized, color-filled, custom-colored, consist of different designs and variations, color designs and variations, decorative designs, logos, symbols, font changes, unlimited characters per phrase, artwork, etc.; (7) a silicone adhesive product that can also be also be printed on top to further customize. It can also be inlayed, imprinted, screen printed or debossed; (8) a silicone adhesive product that can be trimmed to desired size and shape prior to application; (9) a silicone adhesive product that can be layered for additional protection, cushioning, vibration dampening or decorative effect; (10) a silicone material with adhesive backing that is used as a bumper guard for racquet sports, (11) a silicone material with adhesive backing that can be applied without removal for restringing; (12) a silicone adhesive product that can be modified to include thin ribs to assist in keeping the product aligned; and (13) a silicone adhesive product that can be modified to exhibit more rounded edges that hinder the product from pulling away from the sports racquet frame.

Figure 7:
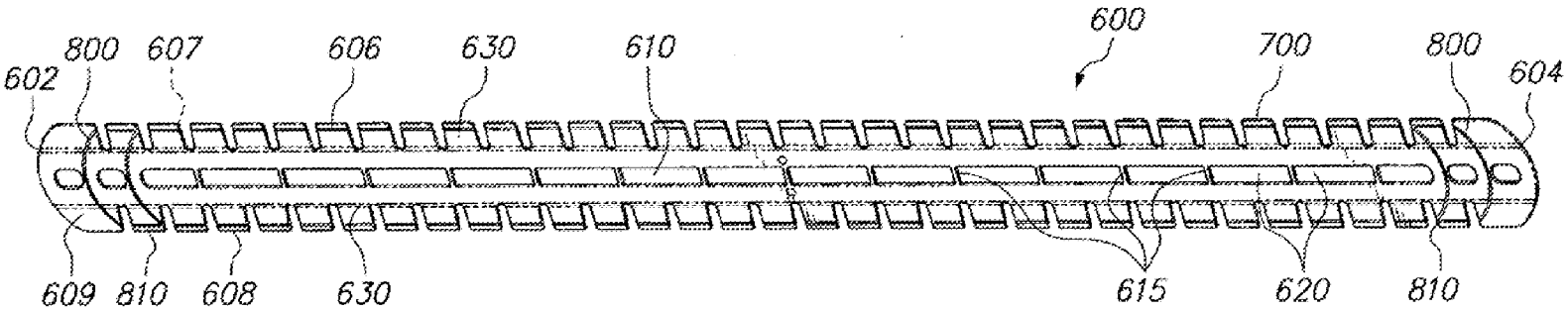
FIG. 7 is a front perspective view of a silicone article in accordance with another embodiment of the present invention.
Figure 8:
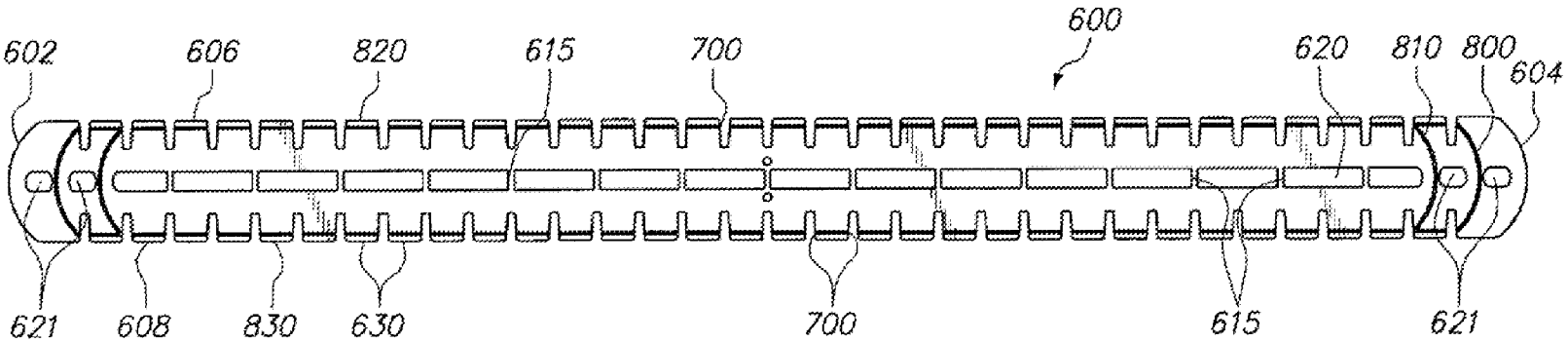
FIG. 8 is a front elevation view of the article of FIG. 7.
Figure 9:
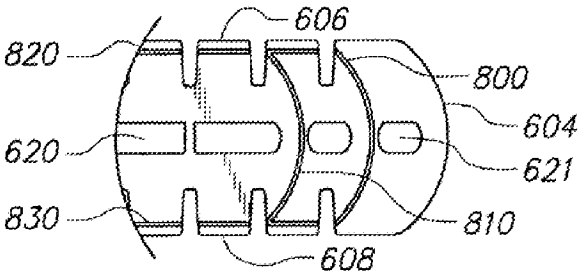
FIG. 9 is close up of an end portion of the article shown in FIG. 8.

FIGS. 7-9 illustrate an article 600 in the form of a bumper or head guard or head protector for use in racquet sports and in particular for use with a sports racquet generally shown at 200 in FIG. 1. However, as described above, the article 600 can be modified to have other applications.

The article 600 includes a body that has a first end 602 and an opposing second end 604, as well as, a first side edge (peripheral edge) 606 and an opposing second side edge (peripheral edge) 608. The side edges 606, 608 extend between the two ends 602, 604 and are spaced from one another. The article 600 also includes an inner face or surface 607 and an outer face or surface 609.

In one embodiment, the first and second ends 602, 604 and optionally the first and second side edges 606, 608 are in the form of rounded edges of the article 600. In other words, the ends and edges are not straight cut edges but have a curved or rounded appearance. The rounded nature of ends and edges provides a number of advantages to the article 600 and in particular, the arcuate (curved) nature of the edges and ends decreases the likelihood that the article 600 will catch on another member that could lessen the bond between the article 600 and the racquet 200 itself. In other words, the curved (rounded) edges and ends hinder the article 600 being pulled away from the racquet frame.

The article 600 includes a central opening or slot 610 that extends at least partially along a length of the article 600 in the center section thereof. As shown in FIGS. 7-9, the slot 610 extends along a substantial length of the article 600 but terminates prior to ends 602, 604. The slot 610 can have any number of different shapes; however, in the illustrated embodiment, the slot 610 is a relatively thin elongated slot. It will be appreciated that in one embodiment, the slot 610 is not continuous but rather is segmented in that there are a plurality of ribs 615 (connecting segments) that extend across the slot 610 at preselected locations so as to define a plurality of enclosed slot segments 620. Each slot segment 620 is isolated from adjacent slot segments and thus represents a distinct through opening.

In the case of the article 600 being in the form of a bumper guard for use in racquet sports, each slot segment 620 is designed to permit access to the strings 210 to permit restringing or repair thereof. In addition, the inclusion of the slot 620 reduces the overall weight of the article 600 while not adversely impacting the protective and vibration damper characteristics thereof. The thin ribs 615 assist in the article 600 staying aligned. In one embodiment, the ribs 615 are spaced about one inch apart from one another.

In addition, more than one type of openings or slots formed in the article 600 can be formed and as shown in FIGS. 7-9, there can be a plurality of slot segments 620 and also a plurality of openings 621 that have different shapes. For example, the openings 621 can have a circular or oval shape and the body segments between the openings 621 and between the opening 621 and the distalmost segment 620 can be different than the ribs 615 that are formed between the slot segments 620.

In addition, the article 600 can include a plurality of notches 700 that are formed along each of the first side edge 606 and along the second side edge 608 (between the ends 602, 604). Each notch 700 can have a tapered construction in that the width of the notch 700 at its closed end is not the same as the width at its open end. In the illustrated embodiment, the width at the open end is slightly greater than the width at the closed end and therefore, the notch 700 has an outward taper toward the respective edge 606, 608. The formation of the notches 700 defines a plurality of flexible fingers or tabs, generally indicated at 630.

The notches 700 formed along the edge 606 and the notches 700 formed along the edge 608 are axially aligned. In other words, one notch 700 on the edge 606 is axially aligned with the corresponding notch 700 on the opposite edge 608 (i.e., one notch 700 is formed across from one notch 700). The notches 700 are thus formed longitudinally along each of side edges 606, 608.

The notches 700 and formation of flexible fingers 630 allows the article 600 to more easily bend along the surface to which the article 600 is applied when the surface is a curved surface. In other words, the notches 700 prevents the article 600 from buckling as the article 600 is applied to a curved surface, such as a racquet head as described below. More particularly, when the article 600 is applied to a curved surface, some of the fingers 630 along the curved portion of the surface can be drawn closer to one another due to the flexing and bending action of the article 600. In addition, the formation of the notches 700 also reduces the overall amount of material that is used to make the article 600. This leads to a reduction in the manufacturing costs and also provides the above advantage without jeopardizing or impacting the structural integrity of the article 600.

Similar to the article 100, the article 600 is intended to be used with and secured to a racquet, such as tennis racquet 200 (FIGS. 1 and 4) or a racquetball racquet 500 (FIG. 5) or any other type of hand racquet. In this application, the article 100 can be referred to as being a tennis racquet head guard, head protector, or specialized head tape. In order to securely attach the article 600 to the racquet head 205, the inner surface 607 includes some means for securely coupling the article 600 thereto. For example, the means can be in the form of an adhesive material with a protective covering that is removed at the time of application of the article 600 to the racquet head 205. Suitable adhesive materials are disclosed hereinbefore with reference to previous embodiments. For example, the inner surface 607 can include a first fastener 300 (FIG. 1) in the form of an elongated strip that extends along a length of the article 600 adjacent one edge 606 and a second fastener 310 in the form of an elongated strip that extends along a length of the article 100 adjacent the edge 608.

In the illustrated embodiment, the end 602 and the end 604 are both curved (arcuate) ends.

The article 600 also includes a number of debossed sections that permit customization of the article 600. For example, the article 600 can include a set of first deboss end lines 800 that are formed proximate but spaced from the ends 602, 604 and a set of second deboss end lines 810 that are formed more between the first deboss end lines 800. In other words, the second deboss end lines 810 are spaced further from the respective ends 602, 604 than the first deboss end lines 800. As is know, deboss lines are areas of the article 600 that have reduced thickness and therefore, are weakened and provide a guide for where to cut the article 600 to reduce the length of the article 600.

The first deboss end lines 800 are arcuate (curved/crescent) shaped and are orientated so that the deboss end lines 800 mirror the arcuate shaped ends 602, 604. Similarly, the second deboss end lines 810 are arcuate (curved/crescent) shaped and are oriented so that the second deboss end lines 810 mirror both the first deboss end lines 800 and the ends 602, 604.

Each first deboss end line 800 is formed between the openings 621, while each second deboss end line 810 is formed between the innermost opening 621 and the outermost slot segment 620. Ends of the deboss end lines 800 are located at or close to opposing, axially aligned notches 700.

It will be appreciated that the first and second deboss end lines 800, 810 permit customization of the article 600 by altering its length in view of the item to which the article 600 is applied. For example, the length of the article 600 can be reduced a first length by cutting the article 600 along the first deboss end lines 800. After cutting the article 600 about the end lines 800, the resulting ends of the article 600 still have curved (arcuate) shapes. To reduce the length of the article 600 an even greater amount, the article 600 is cut along the second deboss end lines 810. Once again, after cutting the article 600 about the end lines 810, the resulting ends of the article 600 still have curved shapes.

The article 600 also includes a pair of longitudinal deboss lines 820, 830. The deboss line 820 is formed along, proximate to, and spaced from the edge 606, while the deboss line 830 is formed along, proximate to, and spaced from the edge 608. The deboss end lines 820, 830 are parallel to one another. In one embodiment, the width of the deboss line 820, 830 is about 0.031 inch.

The notches 700 intersect and segment the deboss lines 820, 830 and therefore, each flexible finger 630 has a deboss line 820, 830 formed thereon. The longitudinal deboss line is formed proximate to the respective edge 606, 608 and permits the user to lessen the overall width of the article 600 by simply cutting along one or more of the deboss lines 820, 830. For example, to customize the article 600 to have a minimum width, article 600 is cut along each deboss line 820, 830. This results in a reduction in the width of the article 600 from about 1.59 inch to about 1.438 inch. As with the other deboss lines, the longitudinal deboss lines 820, 830 are weakened sections of the article 600 that permit the article 600 to be more easily cut.

Example

In one embodiment, the article 600 can have a length of about 20 inches from end 602 to end 604 and a maximum width (from edge 606 to edge 608) is about 1.59 inch. The thickness of the center portion of the article 600 can be about 0.031 inch. A width of the slot segment 620 can be about 0.250 inch. A minimum width (at the closed end) of the notch 700 is about 0.078 inch.

A length of the article 600 when it is customized by cutting the article 600 along the first end boss lines 800 is about 18.78 inches, while the length of the article 600 when it is customized by cutting the article 600 along the second boss lines 810 is about 17.63 inches. As is know, in the case of applying the article 600 to a racquet, there are different sized racquet heads and therefore, some customization of the article 600 may be desired. Accordingly, customization of the article 600 to achieve lesser overall (longitudinal) lengths is performed by cutting the article 600 along select boss end lines. The width of the article 600 can be reduced by cutting the article 600 along the deboss lines 820, 830.

Figure 10:
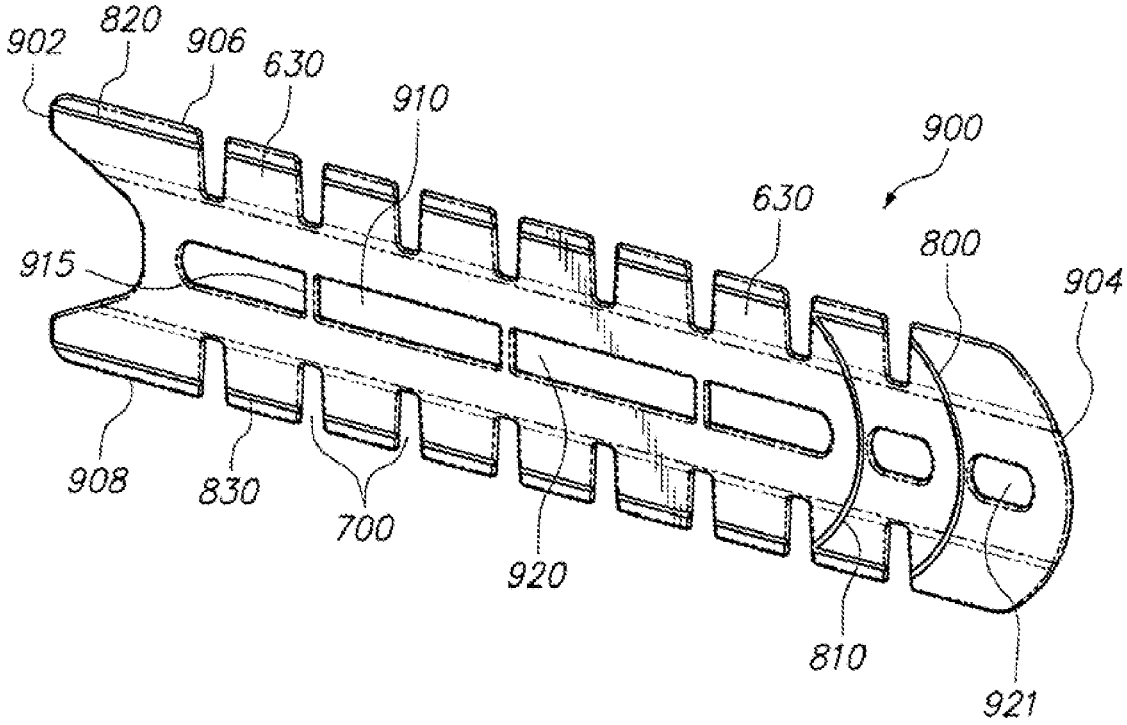
FIG. 10 is a front perspective view of a silicone article in accordance with yet another embodiment of the present invention.

FIG. 10 illustrates an article 900 in the form of a bumper or head guard or head protector for use in racquet sports and in particular for use with a sports racquet generally shown at 200 in FIG. 1. However, as described above, the article 900 can be modified to have other applications.

The article 900 is similar to the article 600 and therefore like elements are numbered alike. In particular, the article 900 includes a body that has a first end 902 and an opposing second end 904, as well as, a first side edge (peripheral edge) 906 and an opposing second side edge (peripheral edge) 908. The side edges 906, 908 extend between the two ends 902, 904 and are spaced from one another. The article 900 also includes an inner face or surface and an outer face or surface.

Unlike the article 600, the article 900 is not symmetric in that the first end 902 does not have the same appearance as the second end 904 as described below. In one embodiment, the first and second ends 902, 904 and optionally the first and second side edges 906, 908 are in the form of rounded edges of the article 900. In other words, the ends and edges are not straight cut edges but have a curved or rounded appearance. The rounded nature of ends and edges provides a number of advantages to the article 900 and in particular, the arcuate (curved) nature of the edges and ends decreases the likelihood that the article 900 will catch on another member that could lessen the bond between the article 900 and the racquet 200 itself. In other words, the curved (rounded) edges and ends hinder the article 900 being pulled away from the racquet frame.

The article 900 includes a central opening or slot 910 that extends at least partially along a length of the article 900 in the center section thereof. As shown in FIG. 10, the slot 910 extends along a substantial length of the article 900 but terminates prior to ends 902, 904. The slot 910 can have any number of different shapes; however, in the illustrated embodiment, the slot 910 is a relatively thin elongated slot. It will be appreciated that in one embodiment, the slot 910 is not continuous but rather is segmented in that there are a plurality of ribs 915 (connecting segments) that extend across the slot 910 at preselected locations so as to define a plurality of enclosed slot segments 920. Each slot segment 920 is isolated from adjacent slot segments and thus represents a distinct through opening.

In the case of the article 900 being in the form of a bumper guard for use in racquet sports, each slot segment 920 is designed to permit access to the strings 210 to permit restringing or repair thereof. In addition, the inclusion of the slot 920 reduces the overall weight of the article 900 while not adversely impacting the protective and vibration damper characteristics thereof. The thin ribs 915 assist in the article 900 staying aligned. In one embodiment, the ribs 915 are spaced about one inch apart from one another.

In addition, more than one type of openings or slots formed in the article 900 can be formed and as shown in FIG. 10, there can be a plurality of slot segments 920 and also a plurality of openings 921 that have different shapes. For example, the openings 921 can have a circular or oval shape and the body segments between the openings 921 and between the opening 921 and the distalmost segment 920 can be different than the ribs 915 that are formed between the slot segments 920.

In addition, the article 900 includes the plurality of notches 700 that are formed along each of the first side edge 906 and along the second side edge 908 (between the ends 902, 904). Each notch 700 can have a tapered construction in that the width of the notch 700 at its closed end is not the same as the width at its open end. In the illustrated embodiment, the width at the open end is slightly greater than the width at the closed end and therefore, the notch 700 has an outward taper toward the respective edge 906, 908. The formation of the notches 700 defines a plurality of flexible fingers or tabs, generally indicated at 630.

End 902 has a different shape than the end 904. The end 904 is arcuate shaped as in article 600; however, the end 902 includes a notch (e.g., concave shaped cut out). The article 900 also includes a number of debossed sections that permit customization of the article 900. For example, the article 900 include the first deboss end line 800 that is formed proximate but spaced from the end 904 and the second deboss end line 810. In other words, the second deboss end line 810 is spaced further from the end 904 than the first deboss end line 800.

The first deboss end line 800 and the second deboss end line 810 are arcuate (curved/crescent) shaped. Ends of the deboss end lines 800 are located at or close to opposing, axially aligned notches 700.

It will be appreciated that the first and second deboss end lines 800, 810 permit customization of the article 900 by altering its length in view of the item to which the article 900 is applied. For example, the length of the article 900 can be reduced a first length by cutting the article 900 along the first deboss end line 800. After cutting the article 900 about the end line 800, the resulting end 904 of the article 900 still have curved (arcuate) shapes. To reduce the length of the article 900 an even greater amount, the article 900 is cut along the second deboss end line 810. Once again, after cutting the article 900 about the end line 810, the resulting end 904 of the article 900 still has a curved shape. The reduction in the length thus occurs at the end 904.

The article 900 also includes the pair of longitudinal deboss lines 820, 830. The deboss line 820 is formed along, proximate to, and spaced from the edge 906, while the deboss line 830 is formed along, proximate to, and spaced from the edge 908. The deboss end lines 820, 830 are parallel to one another.

The article 900 is formed of the same material as the other article described herein and the article 900 functions and has the same advantages as the articles 600, 200.

While the invention has been described in connection with certain embodiments thereof, the invention is capable of being practiced in other forms and using other materials and structures. Accordingly, the invention is defined by the recitations in the claims appended hereto and equivalents thereof.

What is claimed is:

1. A head guard for use with a sports racquet comprising:

an elongated silicone rubber article having first and second side edges and a central slot formed therethrough, the slot being divided into a number of discrete segmented openings by a plurality of integral transverse ribs that extend across the slot at spaced intervals, the article having at least one fastening element located along an inner surface thereof that mates with an outer edge of a head of the sports racquet for coupling the article thereto.

2. The head guard of claim 1, wherein the first and second side edges are rounded edges to reduce the chance of unintended removal of the article from the sports racquet.

3. The head guard of claim 1, wherein first and second opposite ends of the article comprises rounded edges.

4. The head guard of claim 1, further including a locator for locating the article relative to the outer edge of the head.

5. The head guard of claim 4, wherein the locator comprises a pair of markers located along the inner surface of the article in a middle thereof.

6. The head guard of claim 1, further including indicia formed on an outer surface of the article that is visible after mating the article to the head.

7. The head guard of claim 1, wherein the indicia is embossed and formed at the same time as when the article is manufactured.

8. The head guard of claim 1, wherein the fastening element comprises a first and second segments of adhesive material formed between the first and second edges and the slot, respectively, the adhesive material having a releasable protective cover.

9. The head guard of claim 1, wherein the article is provided in a roll and is cutable to a desired length.

10. The head guard of claim 1, wherein a width of the slot is selected to allow a user to access strings that are part of the racquet and are located below but aligned with the slot.

11. The head guard of claim 1, wherein the ribs are perpendicular to the first and second side edges.

12. A head guard for use with a sports racquet comprising:

an elongated silicone rubber article having first and second side edges and a central slot formed therethrough, the slot being divided into a number of discrete segmented openings by a plurality of integral transverse ribs that extend across the slot at spaced intervals, the article having a plurality of notches formed along the first side edge and the second side edge, the notches defining a plurality of flexible fingers formed longitudinally along a length of the article, the article having at least one fastening element located along an inner surface thereof that mates with an outer edge of a head of the sports racquet for coupling the article thereto.

13. The head guard of claim 12, wherein each notch has an outwardly tapered shape.

14. The head guard of claim 12, further including a first set of end deboss lines that extend across a width of the article, each deboss line having an arcuate shape that mirrors the free end of the article.

15. The head guard of claim 14, further including a second set of end deboss lines formed between the first set of deboss lines, each deboss line having an arcuate shape that mirror the free end of the article.

16. The head guard of claim 12, further including a pair of longitudinal deboss lines formed proximate but spaced from the first and second side edges, the longitudinal deboss lines being partitioned by the notches.

17. A method for protecting a head of a sports racquet and for providing vibration dampening of the racquet comprising the steps of:

providing an elongated silicone rubber article having first and second side edges and a central slot formed therethrough, the slot being divided into a number of discrete segmented openings by a plurality of integral transverse ribs that extend across the slot at spaced intervals, the article having at least one fastening element located along an inner surface thereof;

aligning the article relative to an outer edge of the head of the sports racquet such that tensioned string segments that are part of the strings that form a striking surface of the racquet are accessible through the segmented openings; and securely adhering the inner surface of the article to the outer edge of the head by means of the at least one fastening element.

18. The method of claim 17, further including the steps of:

forming an integral locating feature along an inner surface of the article in a middle thereof;

aligning the article to the outer surface of the head using the locating feature.

19. The method of claim 17, wherein the at least one fastening element comprises a pair of strips of adhesive material each of which is covered with a removable release paper.

20. The method of claim 17, wherein the first and second edges of the article roll over peripheral edges of a frame of the racquet.

21. The method of claim 17, wherein the step of aligning includes aligning the slot so that it is disposed over a grommet strip of the head of the racquet.

* * * * *